US007213424B2

(12) United States Patent
Dewalch

(10) Patent No.: US 7,213,424 B2
(45) Date of Patent: May 8, 2007

(54) ROTATION RESTRICTED LOCKING APPARATUS AND METHOD

(75) Inventor: Binz Dewalch, Houston, TX (US)

(73) Assignee: DeWalch Technologies, Inc., Houston, TX (US)

( * ) Notice: Subject to any disclaimer, the term of this patent is extended or adjusted under 35 U.S.C. 154(b) by 0 days.

(21) Appl. No.: 11/027,320

(22) Filed: Dec. 30, 2004

(65) Prior Publication Data

US 2005/0178171 A1 Aug. 18, 2005

Related U.S. Application Data

(63) Continuation of application No. 10/441,145, filed on May 19, 2003, now abandoned, which is a continuation-in-part of application No. 08/301,516, filed on Sep. 7, 1994, now Pat. No. 6,386,006, which is a continuation-in-part of application No. 08/053,589, filed on Apr. 27, 1993, now abandoned.

(51) Int. Cl.
*E05B 67/36* (2006.01)
*B65D 55/14* (2006.01)

(52) U.S. Cl. ..... 70/19; 70/34; 70/164; 70/386; 292/256.6

(58) Field of Classification Search ..... 70/34, 70/386, 19, 158–173; 292/256.6, 256.63, 292/256.65; 411/348
See application file for complete search history.

(56) References Cited

U.S. PATENT DOCUMENTS

| | | | | |
|---|---|---|---|---|
| 1,541,735 | A | 6/1925 | Oberg | |
| 1,554,958 | A | 9/1925 | Falk | |
| 1,692,826 | A * | 11/1928 | Ganz | 70/231 |
| 2,062,685 | A | 12/1936 | Tinnerman | |
| 3,083,563 | A | 4/1963 | Greenwald | |
| 3,392,471 | A | 7/1968 | Foote | |
| 3,600,912 | A | 8/1971 | Foreman | |
| 3,914,965 | A | 10/1975 | Paxton | |

(Continued)

FOREIGN PATENT DOCUMENTS

| | | |
|---|---|---|
| CH | 474653 | 6/1969 |
| DE | 9372/68 | 8/1879 |

OTHER PUBLICATIONS

INNER-TITE®, Barrel Locks and Keys for Electric Utilities, Inner-Tite webpage (visited Oct. 11, 2006) <http://www.inner-tite.com/ebarrellock.html> (3 pages).

INNER-TITE®, "Things are locking up . . . ", International Utility Revenue Protection Association (IURPA) Newsletter, Sep. 1993, IURPA (1 page).

*Primary Examiner*—Lloyd A. Gall
(74) *Attorney, Agent, or Firm*—Arnold & Ferrere, L.L.P.

(57) ABSTRACT

The present disclosure relates to preventing rotation of a barrel lock when opened by a key. At least one example embodiment includes a rotationally actuated barrel lock for securing electric meter boxes and the like, and a spring loaded clip for mounting inside the meter box. Lock actuation is characterized by rotation of a key relative to the lock. The barrel lock includes a head portion, and a smaller diameter shank portion with flatted areas thereon. The clip includes, in at least one example, a lock receiving opening with internal protrusions which engage the flatted areas on the lock shank, thereby preventing rotation of the lock when it is engaged by the key.

3 Claims, 11 Drawing Sheets

U.S. PATENT DOCUMENTS 3,968,985 A 7/1976 Nielsen, Jr. et al.
4,030,321 A 6/1977 Kenyon
4,031,720 A 6/1977 Avaiusini
4,107,959 A 8/1978 Skarzynski et al.
4,193,276 A 3/1980 Lundberg
4,289,000 A 9/1981 Nielsen, Jr.
4,313,319 A 2/1982 Haus, Jr. et al.
4,331,012 A 5/1982 Swisher
4,347,720 A * 9/1982 Kenyon ..... 70/14
4,391,110 A * 7/1983 Nielsen, Jr. ..... 70/34
4,541,256 A 9/1985 Green
4,570,466 A 2/1986 Matthews
4,579,311 A 4/1986 Spranza, III
4,688,405 A 8/1987 Epstein
4,702,093 A 10/1987 DeWalch
4,708,007 A 11/1987 Stoia
4,742,703 A 5/1988 DeWalch et al.
4,946,130 A * 8/1990 Kooiman ..... 251/95
5,001,912 A 3/1991 DeWalch
5,077,993 A * 1/1992 Blair et al. ..... 70/161
5,085,063 A 2/1992 Van Dyke et al.
5,086,631 A 2/1992 Agbay
5,127,244 A 7/1992 Myers
5,249,442 A 10/1993 Wright
5,255,542 A 10/1993 Fortin
5,440,909 A 8/1995 Ely et al.
5,542,273 A 8/1996 Bednarz
5,544,506 A 8/1996 Nakano
5,645,384 A 7/1997 Wright et al.
6,386,006 B1 5/2002 DeWalch

* cited by examiner

FIG. 3
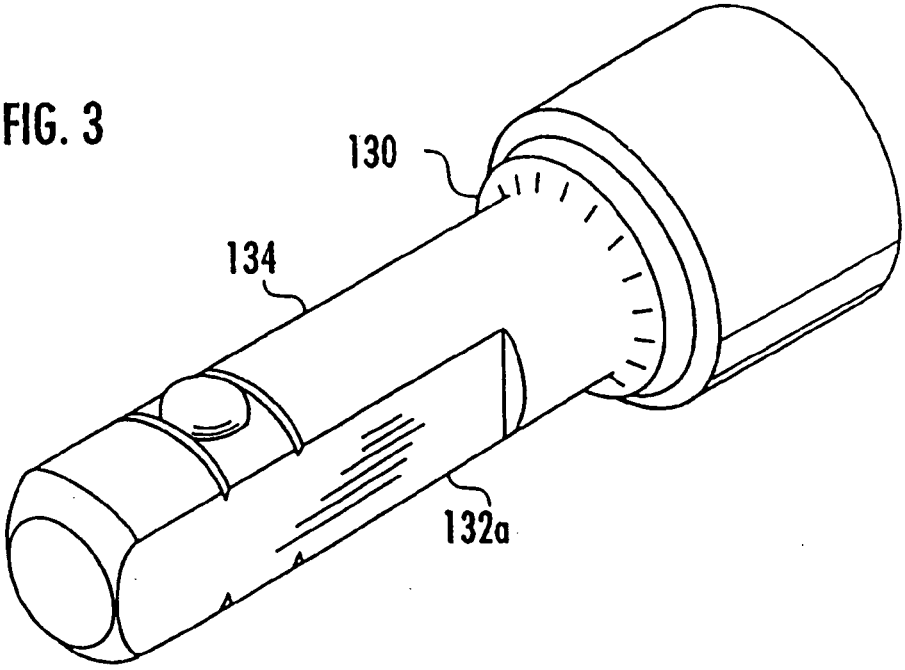
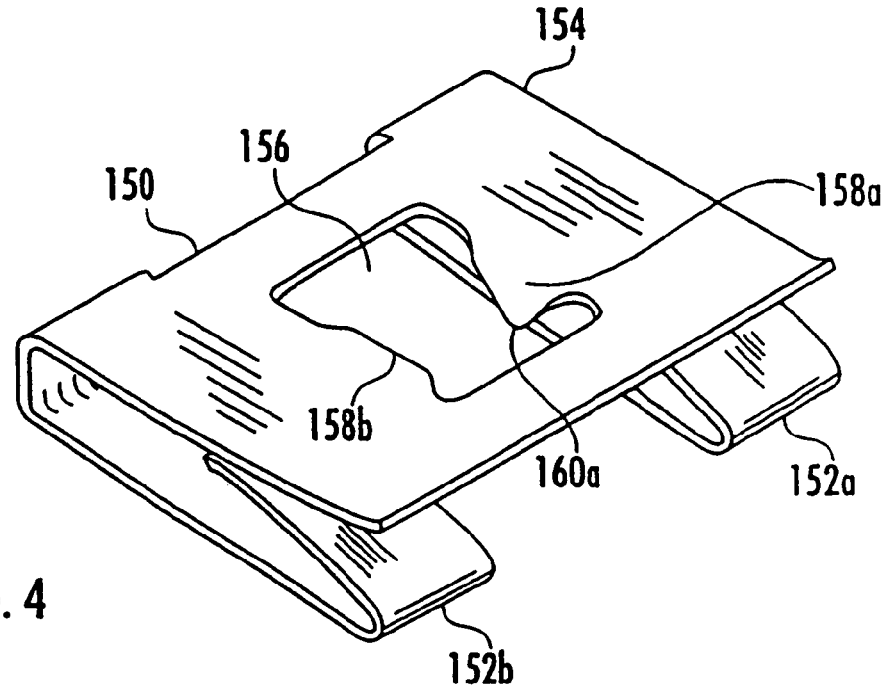
FIG. 4

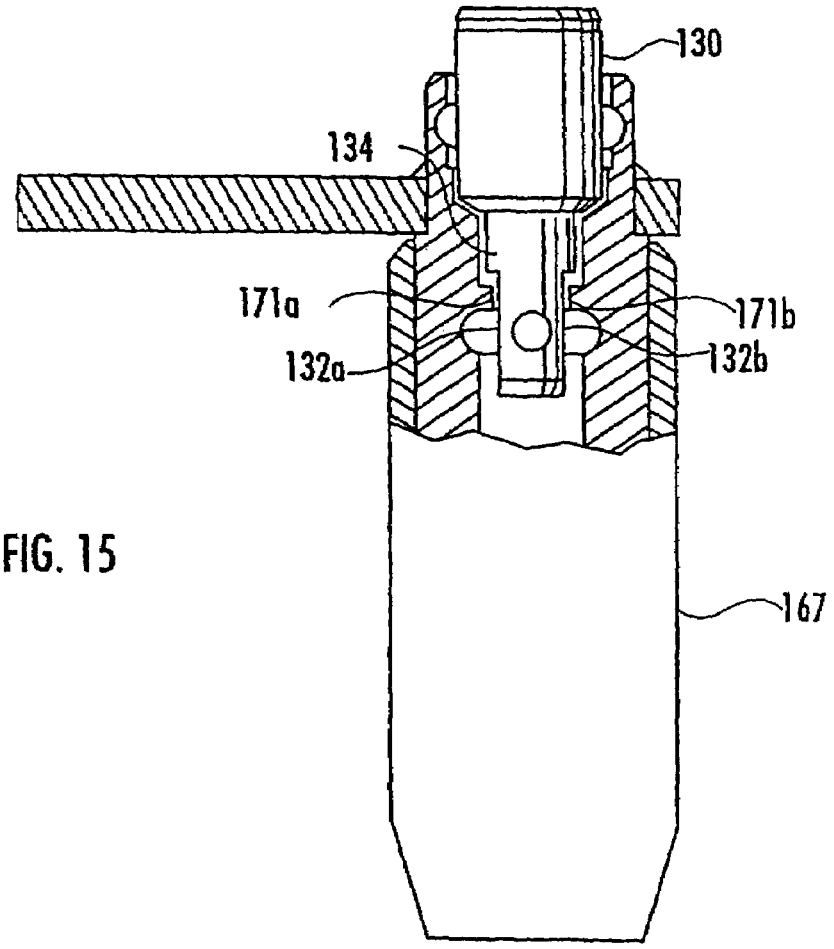
FIG. 15
FIG. 16
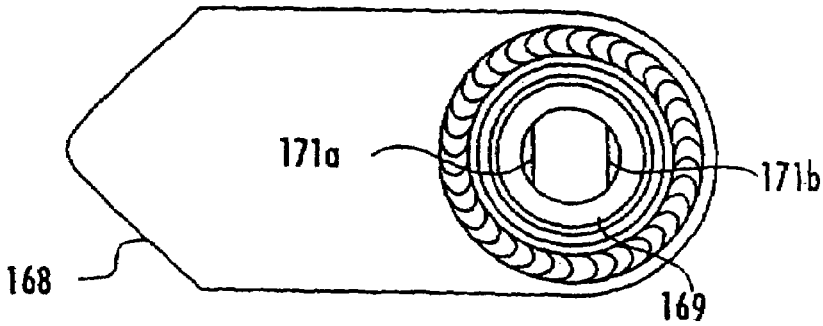

ROTATION RESTRICTED LOCKING APPARATUS AND METHOD

CROSS-REFERENCE TO RELATED APPLICATIONS

This application is a continuation of Ser. No. 10/441,145, filed May 19, 2003, now abandoned, which is a continuation-in-part of Ser. No. 08/301,516, filed Sep. 7, 1994, now U.S. Pat. No. 6,386,006, which is a continuation-in-part of Ser. No. 08/053,589, filed Apr. 27, 1993, now abandoned, to which the instant application claims priority.

BACKGROUND

This invention relates to barrel locks, specifically to means for preventing rotation of a barrel lock when opened by a key.

Barrel locks are used to secure meter rings like the ones shown in U.S. Pat. No. 4,702,093 (DeWalch, 1987), as well as a variety of other locking hardware. In the present disclosure, the term "locking hardware" is used to refer to any device which is secured by a barrel lock. A barrel lock, as defined in the present disclosure, is commonly characterized as having a generally cylindrical case with a head portion, a smaller diameter shank portion, and a shoulder portion interposed between the head and shank portions. The shank portion includes retaining means, usually a pair of retractable steel balls, to prevent extraction of the lock from the meter ring or other locking hardware when the lock is locked. Usually barrel locks are removed from the locking hardware when they are unlocked. In many cases removal of the lock is required for opening the locking hardware.

Many barrel locks, such as the one described in U.S. Pat. No. 4,289,000 (Nielsen, 1981), rely on axial movement of the key to actuate the lock. Although the operation of axially actuated locks is independent of lock rotation, these locks have a relatively small number of possible key codes, are often easy to pick, and require the use of a rather large and cumbersome key. To overcome these difficulties, barrel locks have been developed which are actuated by rotation of the key relative to the lock. In the present disclosure, this type of lock will be referred to as a "rotationally actuated barrel lock."

The generally cylindrical shape of most barrel locks allows them to rotate freely within the locking hardware. Although rotationally actuated barrel locks have many advantages, their rotation within the locking hardware can potentially cause a problem during lock actuation. Whenever the torque required to unlock the lock is greater than the torque required to rotate the lock within the locking hardware, the entire lock will rotate with the key. Since no relative rotation occurs between the lock and the key, the lock remains locked. In this situation, the user is clearly in need of some means to induce the relative rotation of the lock and key.

BRIEF SUMMARY OF THE INVENTION

In at least one example of the invention, there is provided a method for the prevention of rotation of a rotationally actuated barrel lock, wherein the barrel lock is removable from locking hardware when unlocked. In at least one example, the barrel lock includes a head portion, a smaller diameter shank portion, a retractable retaining means, a shoulder portion disposed between the head portion and the shank portion, and at least one cooperative rotation restricting surface. The method comprises, in at least one example, receiving the barrel lock in locking hardware and contacting at least one cooperative rotation restricting surface of the barrel lock with at least a second rotation restricting surface on the locking hardware.

In a further example of the invention, the barrel lock further comprises retaining means located on a shank portion.

In another example of the invention, the contacting comprises maintaining non-permanent contact; while, in another embodiment, the contacting comprises maintaining permanent contact.

In yet a further example, the method further comprises locating the at least a second rotation restricting surface within locking hardware.

According to still a further example, the at least a second rotation restricting surface further comprises a complementary aperture and the receiving comprises receiving the barrel lock within the complementary aperture.

In yet a further example, the at least a second rotation restricting surface is attached to a key for the barrel lock.

In still at least one more example, the method further comprises securing the second rotation restricting surface outside of locking hardware.

In still another example, the at least one second rotation restricting surface comprises an essentially non-circular receiving aperture (for example, at least one flat surface).

According to yet a further example, the method further comprises securing the barrel lock to locking hardware (for example, restricting the removal of the barrel lock). In still a further example, the securing further comprises non-permanently securing.

In an even further example, the method further comprises securing the second rotation restricting surface to locking hardware (for example, clipping the rotation restricting surface to the locking hardware).

According to another example of the invention, there is provided a method of retrofitting locking hardware to receive a barrel lock with a cooperative rotation restricting surface. The method comprises providing at least a second rotation restricting surface, and securing the at least a second rotation restricting surface to the locking hardware.

In a further example of the invention, the shape of the second cooperative rotation restricting surface is essentially complementary to the cooperative rotation restricting surface of the barrel lock.

In a further example of the invention, the securing further comprises securing the at least a second rotation restricting surface within the locking hardware (for example, clipping the at least a second rotation restricting to the locking hardware, wedging the at least a second rotation restricting surface within the locking hardware, and/or pressing the at least a second rotation restricting surface within the locking hardware).

In further examples, the securing further comprises permanently securing or non-permanently securing.

In still yet a further example, the method comprises securing the at least a second rotation restricting surface outside of the locking hardware.

In another example of the invention, there is provided a method for securing a meter to a meter box with a barrel lock having a cooperative rotation restricting surface. The method comprises surrounding at least a portion of the meter box with a surrounding surface, surrounding at least a portion of the meter with the surrounding surface, securing the surrounding surface to the meter box, and maintaining contact of at least one cooperative rotation restricting surface of the barrel lock with at least a second rotation restricting surface on locking hardware.

According to at least one example, the surrounding surface comprises a meter ring.

According to yet a further example, the securing to the meter box comprises locking the surrounding surface.

In another example of the invention, there is provided a system for prevention of rotation of a rotationally actuated barrel lock within meter locking hardware. The system comprises a means for receiving the barrel lock, and a means for maintaining contact (permanent or non-permanent) of at least one cooperative rotation restricting surface of the barrel lock with at least a second rotation restricting surface on the meter locking hardware.

In a further example of the invention, the barrel lock comprises retaining means located on a shank portion.

According to an even further example, the system further comprises a means for locating said at least a second rotation restricting surface within locking hardware.

According to still an even further example, the at least a second rotation restricting surface further comprises a complementary aperture, and the means for receiving comprises a means for receiving the barrel lock within said complementary aperture.

In a further example, the at least a second rotation restricting surface is secured outside locking hardware.

According to still a further example, the system further comprises a means for securing the second rotation restricting surface outside of the locking hardware.

In at least one more example, the at least a second rotation restricting surface comprises an essentially non-circular receiving aperture.

In yet a further example, the system further comprises a means for securing the barrel lock to meter locking hardware.

In still yet a further example, the means for securing further comprises a means for restricting the removal of the barrel lock.

In still at least one more example, the system further comprises a means for securing the second rotation restricting surface to locking hardware (for example, a means for clipping the rotation restricting surface to the locking hardware).

In another example of the invention, there is provided a system of retrofitting locking hardware to receive a barrel lock with a cooperative rotation restricting surface. The system comprises a means for providing at least a second rotation restricting surface, and a means for securing the at least a second rotation restricting surface to the locking hardware.

In a further example of the invention, the shape of the cooperative rotation restricting surface is essentially complementary to the at least a second rotation restricting surface of the barrel lock. In at least one example, the at least a second rotation restricting surface comprises at least a first aperture.

In another example of the invention, there is provided a system for securing a meter to a meter box with a barrel lock having a cooperative rotation restricting surface. The system comprises a means for surrounding at least a portion of the meter box with a surrounding surface, a means for surrounding at least a portion of the meter with the surrounding surface, a means for securing the surrounding surface to the meter box, and a means for maintaining contact of at least one cooperative rotation restricting surface of the barrel lock with at least a second rotation restricting surface.

According to still another example of the invention, there is provided a system for securing a meter to a meter box with a barrel lock having a cooperative rotation restricting surface. The system comprises a means for surrounding at least a portion of the meter box with a surrounding surface, a means for surrounding at least a portion of the meter with the surrounding surface, a means for securing the surrounding surface to the meter box; and a means for maintaining contact of at least one cooperative rotation restricting surface of the barrel lock with at least a second rotation restricting surface on locking hardware.

In yet another example of the invention, the surrounding surface further comprises a meter ring.

According to still a further example, the means for securing to the meter box and the means for securing to the meter further comprises a means for locking the surrounding surface.

In another example of the invention, there is provided an apparatus for the prevention of rotation of a rotationally actuated barrel lock within meter locking hardware. The apparatus comprises at least one cooperative rotation restricting surface the barrel lock, and at least a second rotation restricting surface on the meter locking hardware.

In further example of the invention, the at least a second rotation restricting surface comprises an essentially non-circular surface, and the at least a second rotation restricting surface is essentially complementary with the cooperative rotation restricting surface of the barrel lock.

In still a further example, the cooperative rotation restricting surface of the barrel lock further comprises a flat.

In yet at least one more example, the cooperative rotation restricting surface of the barrel lock further comprises a prong.

In still at least one more example, the cooperative rotation restricting surface of the barrel lock further comprises a notch.

In still another example, the cooperative rotation restricting surface of the barrel lock further comprises a spline.

According to at least one more example, the barrel lock further comprises locking balls.

According to yet a further example, the at least a second rotation restricting surface is located within locking hardware.

According to still yet a further example, the at least a second rotation restricting surface further comprises at least one flat.

In still a further example, the at least a second rotation restricting surface further comprises at least one complementary spline.

In an even further example, the at least a second rotation restricting surface further comprises at least one prong.

In still an even further example, the at least a second rotation restricting surface further comprises at least one notch.

According to an even further example, the at least a second rotation restricting surface further comprises a shape whose interaction with the cooperative rotation restricting surface of the barrel lock prevents rotation.

According to still an even further example, the at least a second rotation restricting surface further comprises a complementary aperture.

In another example, the complementary aperture further comprises a non-circular aperture having flats.

In a further example, the at least a second rotation restricting surface is located outside locking hardware.

According to still another example, the aperture further comprises an enclosure lock.

In yet another example, the non-circular surface comprises a surface without uniform radius.

According to still a further example, the apparatus further comprises a spring clip comprising at least one flat spring, at least one flat plate, and a lock receiving opening, wherein the flat spring and the flat plate are in communication.

In at least one more example, the lock receiving opening is within the flat plate.

In yet a further example, the lock receiving opening further comprises at least one protrusion.

In still yet a further example, the at least one protrusion is bent.

In another example of the invention, there is provided an apparatus for retrofitting locking hardware to receive a barrel lock with a cooperative rotation restricting surface. The apparatus comprises at least one rotation restricting surface, and an attachment means for attaching the rotation restricting surface to the locking hardware.

In a further example of the invention, the shape of the rotation restricting surface is essentially complementary to a cooperative rotation restricting surface of the barrel lock.

In still another example, the attachment means further comprises a spring clip.

According to at least one more example, the rotation restricting surface further comprises at least one prong.

In another example of the invention, there is provided an apparatus for securing a meter to a meter box with barrel lock having a cooperative rotation restricting surface. The apparatus comprises a hoop; a housing connected to the hoop; and a second rotation restricting surface connected to the hoop.

According to a further example of the invention, the housing further comprises a front housing, a rear housing, and a sealing member.

In still a further example, the sealing member further comprises the second rotation restricting surface.

In an even further example, the housing further comprises flats.

In another example of the invention, there is provided an apparatus for securing a meter to a meter box with a barrel lock. The barrel lock has at least one cooperative rotation restricting surface. The apparatus comprises a cover plate, and a lock receptacle connected to the cover plate. Notably, the lock receptacle further comprises at least a second rotation restricting surface.

In a further example of the invention, the lock receptacle further comprises flats.

According to an even further example, the cover plate overlays a door to be locked.

In another example of the invention, there is provided a barrel lock comprising: a head portion and at least one cooperative rotation restricting surface.

In a further example of the invention, the at least one cooperative rotation restricting surface is located on a shank portion.

According to still another example, the at least one cooperative rotation restricting surface comprises a flat.

In yet another example of the invention, the at least one cooperative rotation restricting surface comprises a curve.

According to still a further example, the at least one cooperative rotation restricting surface comprises a surface with a non-uniform radius.

In at least one more example, the at least one cooperative rotation restricting surface comprises a spline.

In yet a further example, the at least one cooperative rotation restricting surface comprises a prong.

In still yet a further example, the prong is located generally opposite the end of the barrel lock that the key is inserted.

In yet at least one more example, the prong is located generally on the same end of the barrel lock that the key is inserted.

In still at least one more example, the at least one cooperative rotation restricting surface comprises at least one notch.

In still another example, the notch is located generally on the same end of the barrel lock that the key is inserted.

According to at least one more example, the notch is located generally opposite the end of the barrel lock that the key is inserted.

According to yet a further example, there is provided a method of prevention of rotation of a barrel lock. The barrel lock further comprises an essentially cylindrical case, a head portion, a smaller diameter shank portion, and a shoulder portion interposed between the head and shank portions, wherein the shank portion of the barrel lock comprises a cooperative surface. The method comprises providing a second cooperative surface, whose shape is essentially permanently cooperative with the cooperative surface of the shank portion of the barrel lock, and providing contact between the cooperative surface of the barrel lock and the second cooperative surface.

BRIEF DESCRIPTION OF THE DRAWINGS

FIG. 3 shows an isometric view of the preferred embodiment lock having flats on the shank.

FIG. 4 shows an isometric view of the spring clip.

FIG. 15 shows a cross-sectional view of the meter box lock and barrel lock shown in FIG. 14.

FIG. 16 shows a top view of the meter box lock shown in FIG. 14.

DETAILED DESCRIPTION OF EXAMPLES EMBODIMENTS OF THE INVENTION

Figure 1:
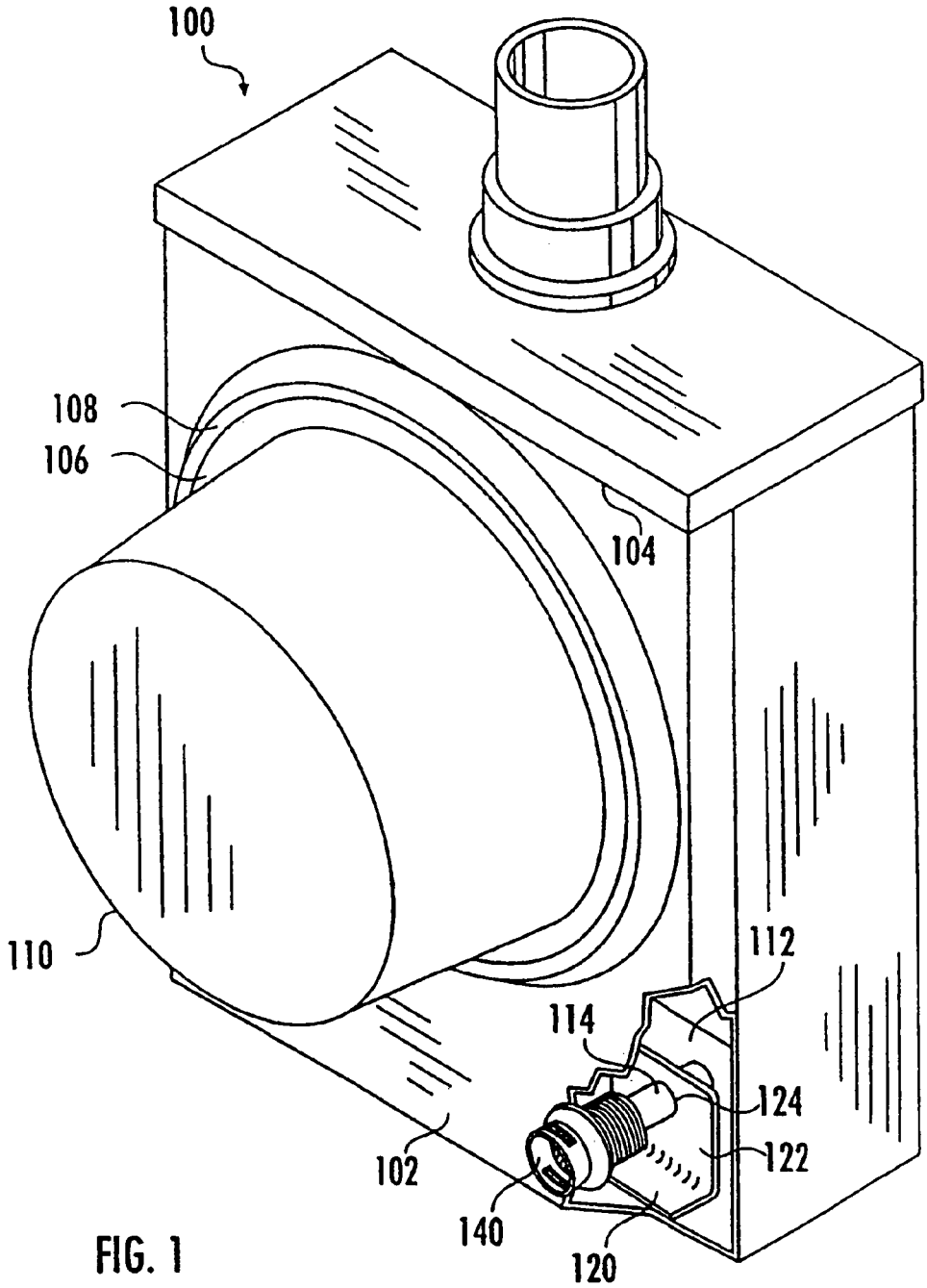
FIG. 1 shows a cutaway view of a barrel lock installed in a typical meter box.

FIG. 1 shows a meter box 100 of the type commonly used in the utility industry. The door 102 of the box 100 is hinged generally at 104 and includes a central hole 106 with a surrounding boss 108 which serves to retain the meter 110. The bracket 120 is welded to the floor 112 of the box and includes a flat portion 122 with a lock receiving aperture 124 therethrough. The door 102 is usually secured with a barrel lock 114, which is inserted into the threaded flange 140 until the locking balls extend beyond the aperture 124 in the bracket 120.

Figure 2:
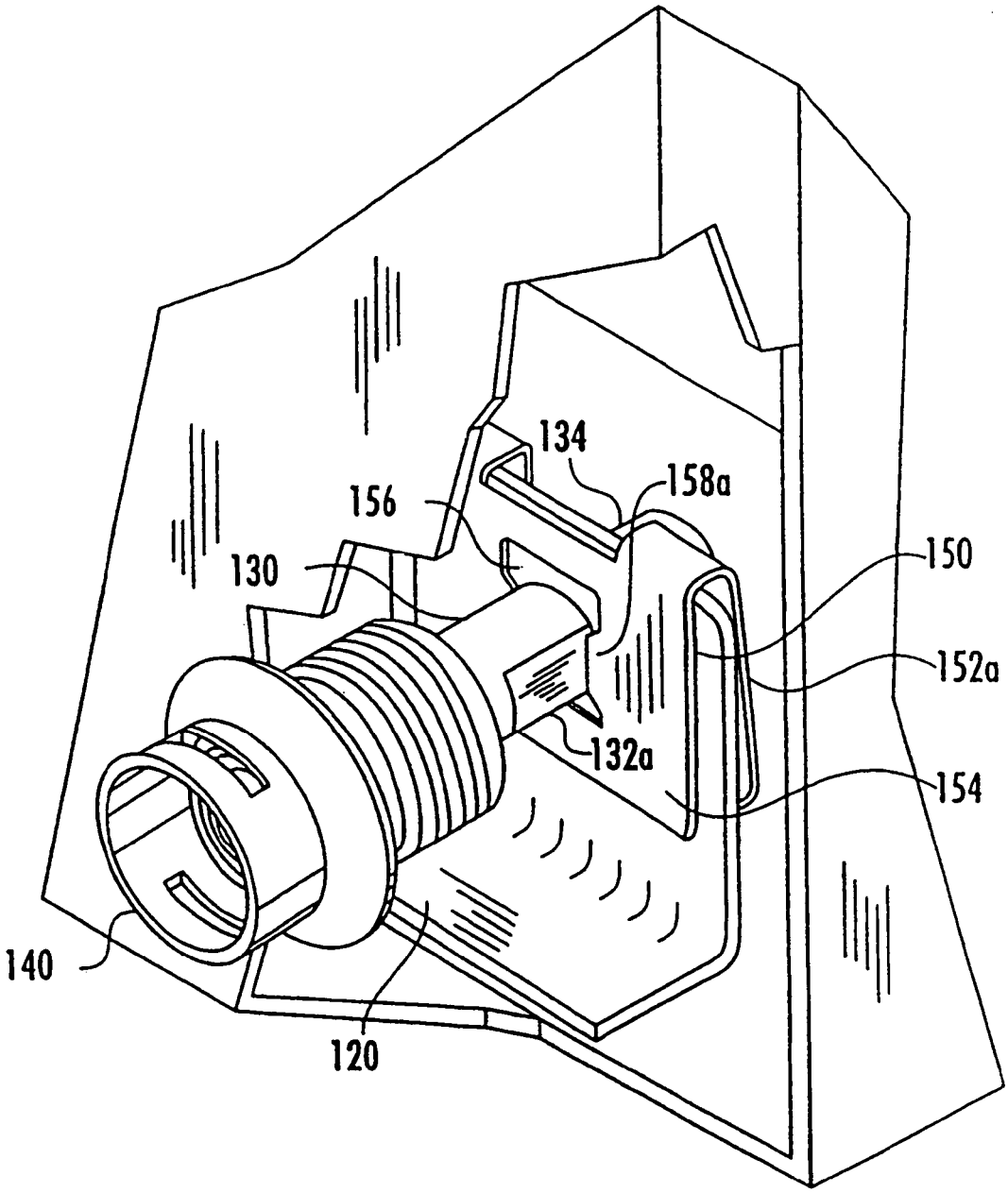
FIG. 2 shows an isometric view of the preferred embodiment spring clip and barrel lock.
Figure 5:
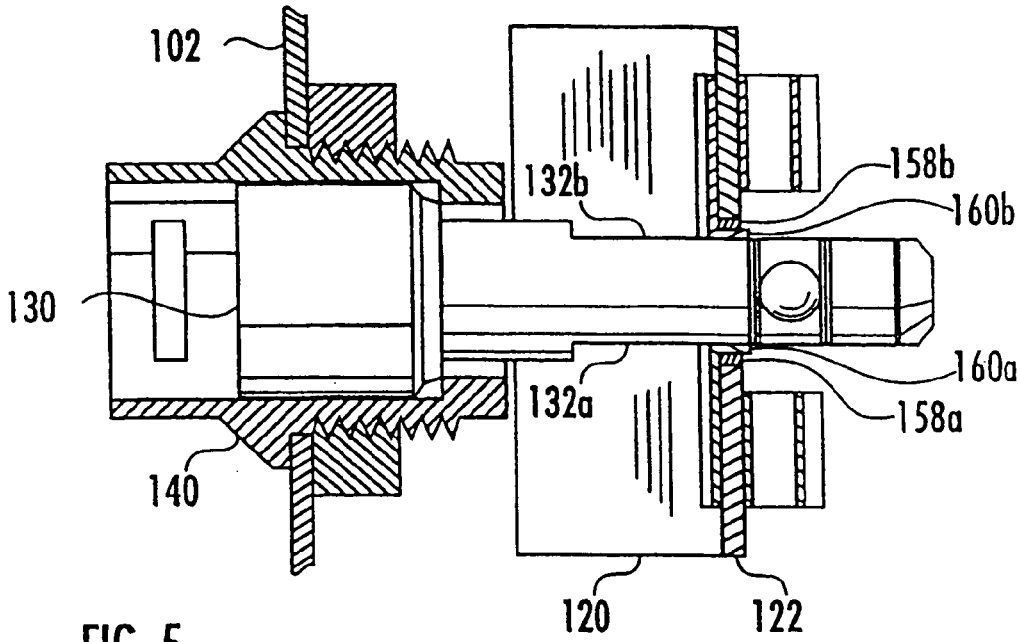
FIG. 5 shows a cross-sectional top view of the embodiment shown in FIG. 2.
Figure 6:
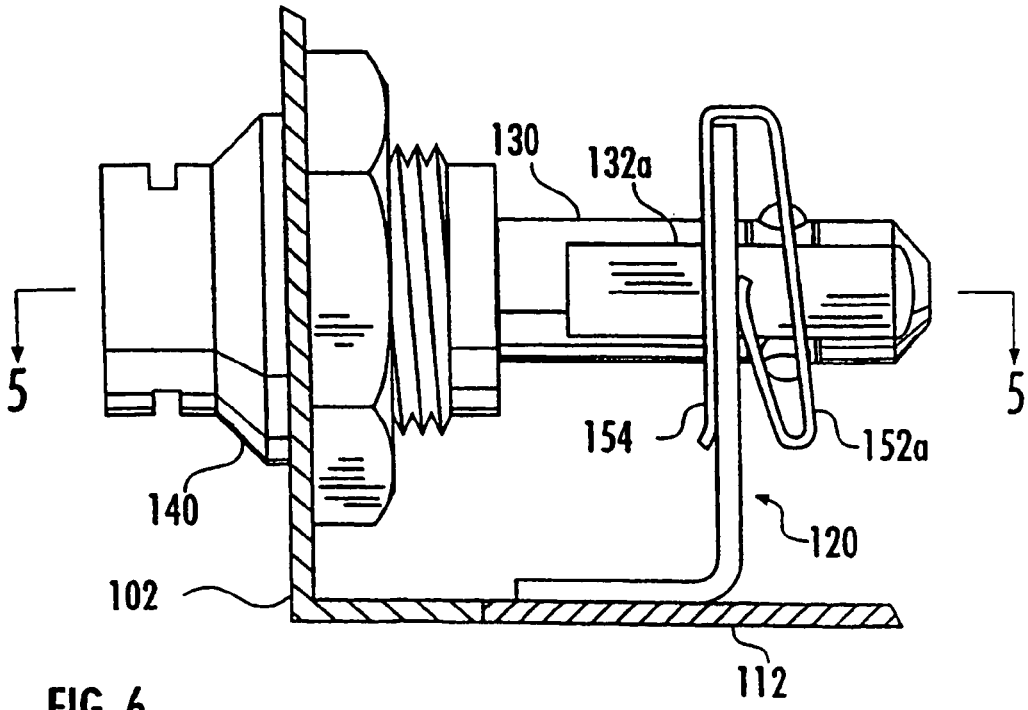
FIG. 6 shows an assembled side view of the embodiment shown in FIG. 2.

Referring to FIGS. 2 through 4, the present embodiment includes a modified lock 130 with two opposing flats such as 132*a* on the shank 134, and a spring clip 150 which is retrofitted onto the bracket 120. The spring clip 150 includes two flat spring portions 152*a* and 152*b*, and a flat plate portion 154 with a lock receiving opening 156 therein. Adjacent to the lock receiving opening 156 are two protrusions 158*a* and 158*b*, which include bent portions 160*a* and 160*b*, as shown in FIGS. 4 and 5. Referring to FIGS. 5 and 6, when the spring clip 150 is installed onto the bracket 120, the bent portions 160*a* and 160*b* extend into the lock receiving aperture 124 in the bracket 120. The flat spring portions 152*a* and 152*b* serve to maintain pressure between the flat plate portion 154 of the spring clip and the bracket, so that the bent portions 160*a* and 160*b* are retained in the aperture 124 and serve to secure the spring clip to the bracket. The protrusions 158*a* and 158*b* are sized and positioned to engage the flats 132*a* and 132*b*, respectively, on the shank 134 of the lock 130, and prevent rotation of the lock. In other embodiments, the clip or the original bracket could be constructed with any internal shaped means designed to engage the flats or other suitable shaped means on the lock case.

Figure 7:
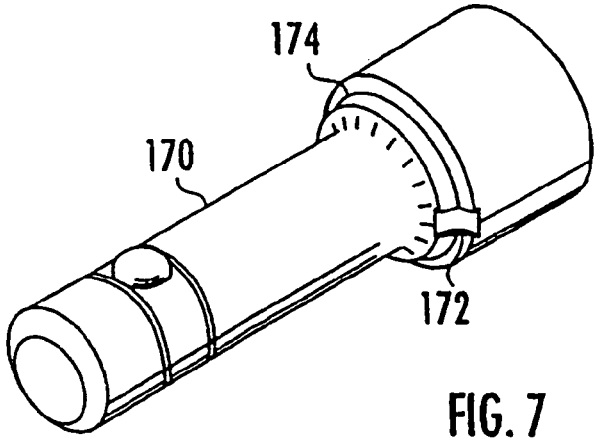
FIG. 7 shows an isometric view of an alternative embodiment barrel lock having a notch on the shoulder.
Figure 8:
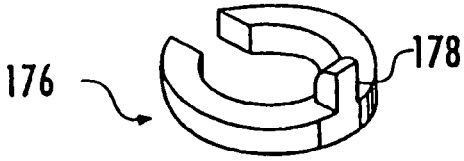
FIG. 8 shows an isometric view of the alternative embodiment pronged split bushing.
Figure 9:
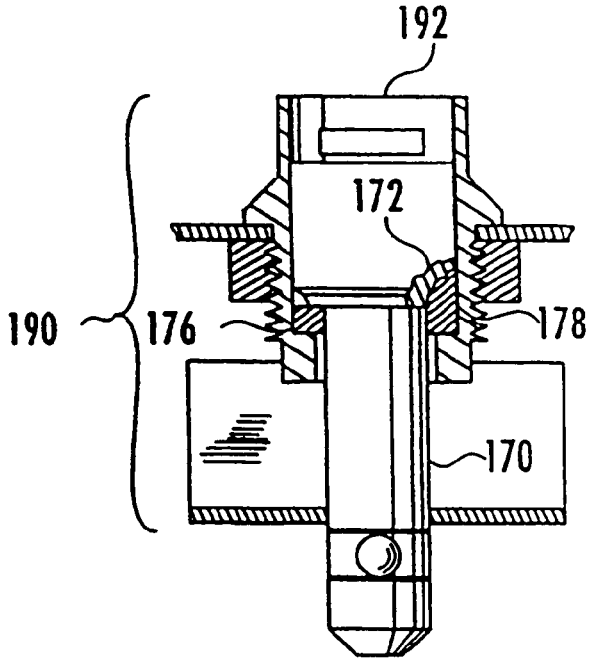
FIG. 9 shows a cross-sectional view of the split bushing installed in locking hardware.
Figure 10:
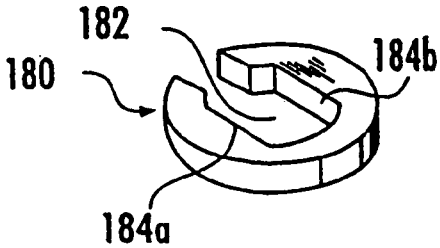
FIG. 10 shows an isometric view of the alternative embodiment flatted split bushing.

FIG. 7 shows an alternative embodiment barrel lock 170 having a notch 172 in the shoulder portion 174. FIG. 8 shows a split bushing 176, with a prong 178 designed to engage the notch 172 in the barrel lock 170. Referring to FIG. 9, the bushing 176 is pressed or otherwise non-rotatably installed in the lock receiving portion 192 of the locking hardware 190 prior to insertion of the lock 170. When the lock is inserted, the notch 172 engages the prong 178, and the lock is prevented from rotating. FIG. 10 shows a split bushing 180 having a central aperture 182 with internal flats 184*a* and 184*b*, which are designed to engage the flats 132*a* and 132*b* on the barrel lock 130 shown in FIG. 3. In other embodiments, any suitable shaped means could be used to non-rotatably couple the bushing and the barrel lock.

Figure 11:
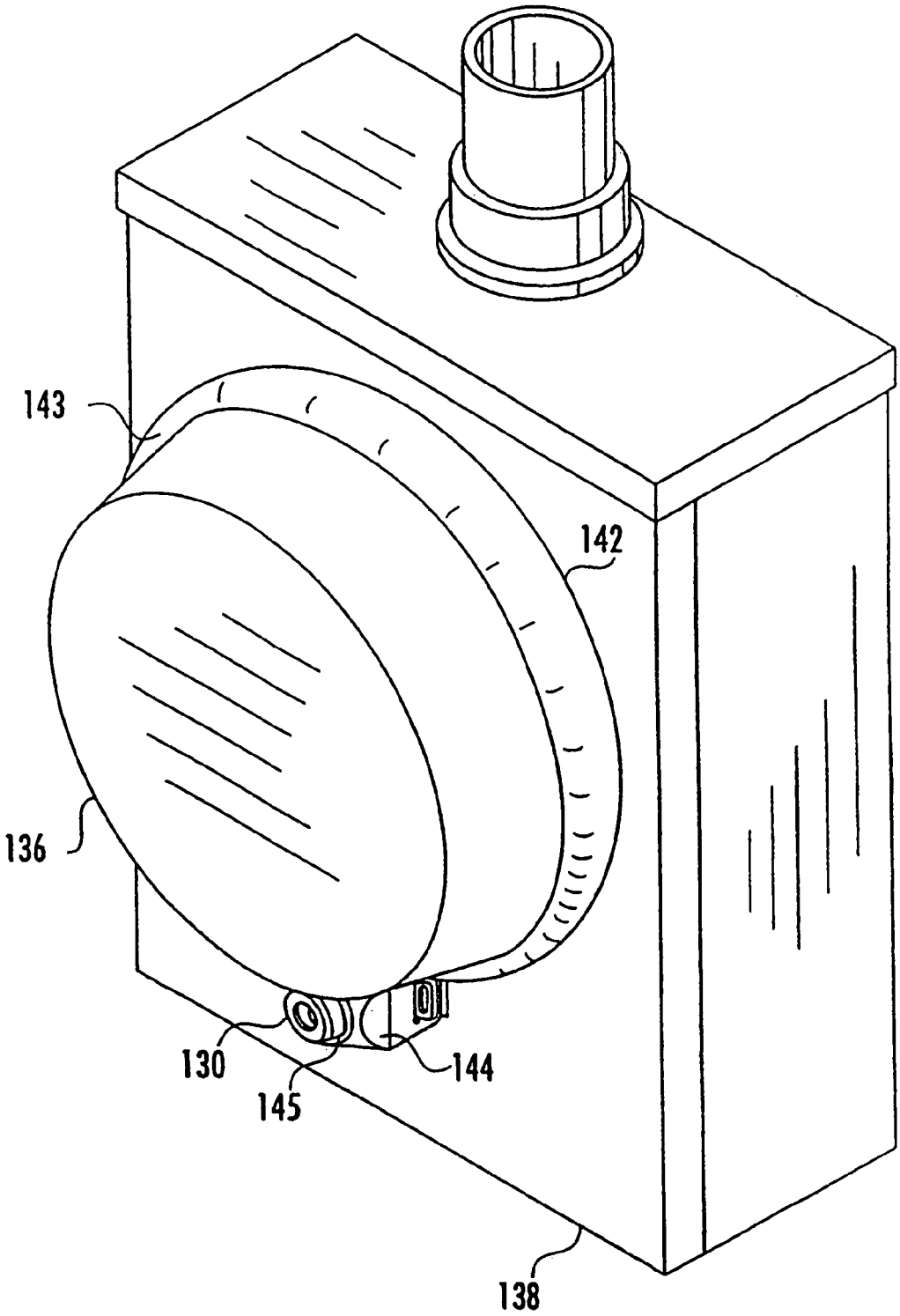
FIG. 11 shows an isometric view of an alternative embodiment meter ring and barrel lock installed on a typical electric meter.
Figure 12:
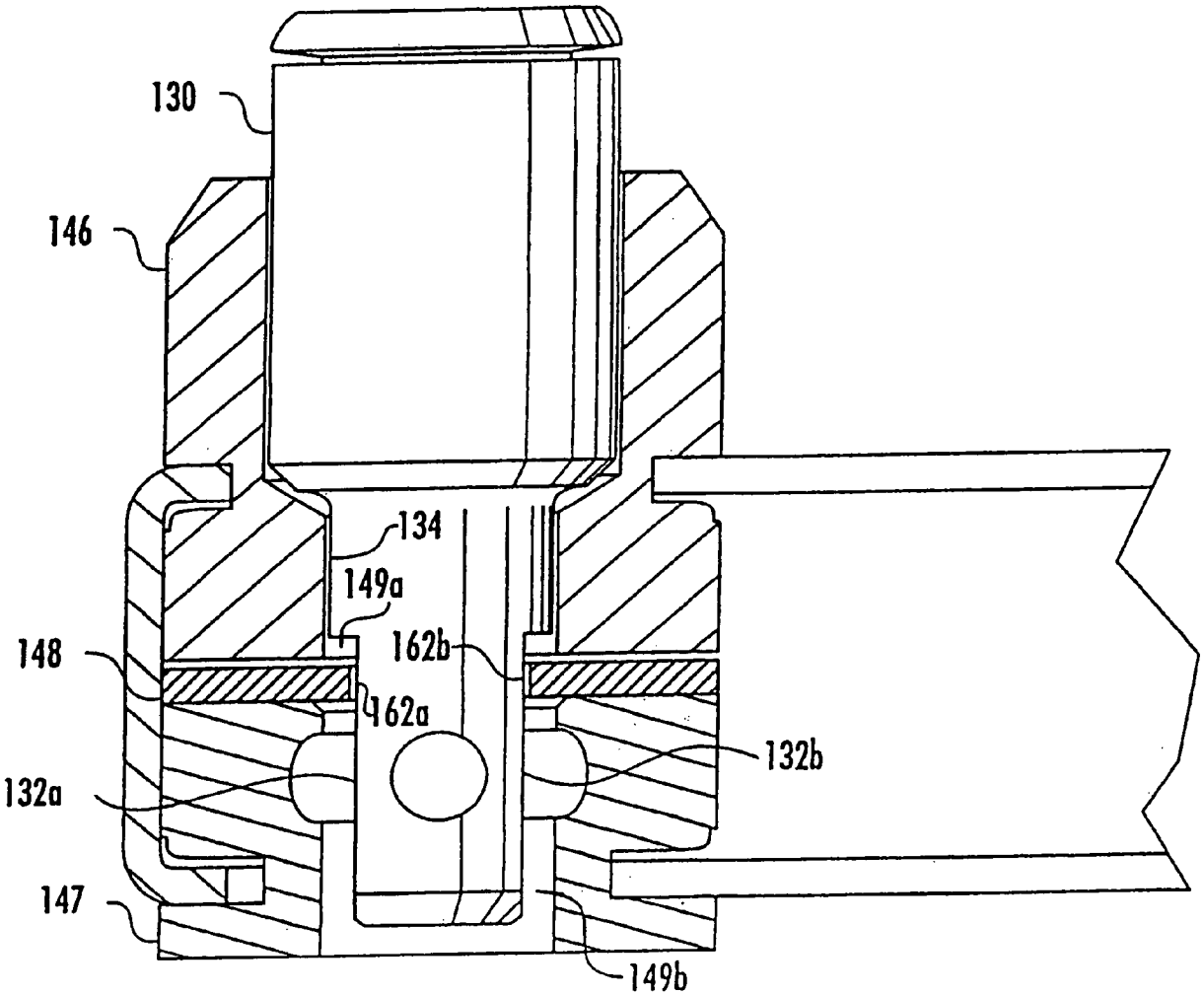
FIG. 12 shows a cross-sectional side view of the meter ring and lock shown in FIG. 11.
Figure 13:
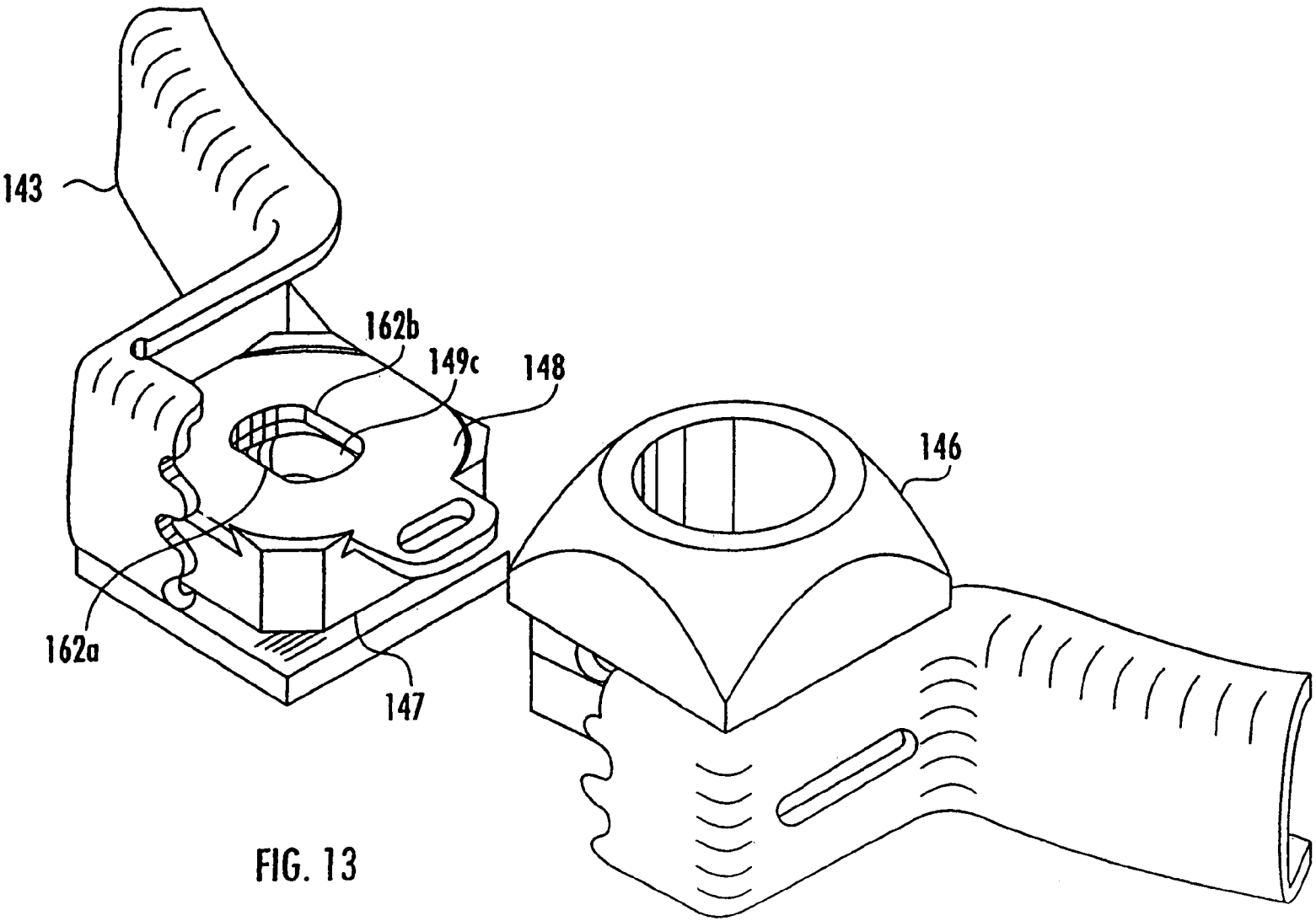
FIG. 13 shows an isometric view of a portion of the meter ring shown in FIG. 11.

FIGS. 11 through 13 show a method for preventing lock rotation in meter locking rings. The meter locking rings or meter ring 142 shown in FIG. 11 retains the meter 136 on the meter box 138 in a manner well known in the industry. The meter ring includes a hoop portion 143, and a housing portion 144 with a lock receptacle 145 for receiving the preferred embodiment barrel lock 130. As shown in FIGS. 12 and 13, the housing portion includes a front housing 146, a rear housing 147, and a sealing member 148, which further include lock receiving apertures 149*a*, 149*b*, and 149*c*, respectively. Referring to FIG. 11, when the meter ring 142 is installed on the meter 136, the lock receiving apertures line up to form the lock receptacle 145 in the housing portion 144. The barrel lock 130 can then be inserted into the lock receptacle. Referring to FIG. 12, the barrel lock 130 has a shank portion 134 with flats 132*a* and 132*b* thereon. Referring to FIGS. 12 and 13, the lock receiving aperture 149*c* in the sealing member 148 has internal flatted areas 162*a* and 162*b* which engage the flats on the barrel lock, thus preventing the barrel lock from rotating when engaged by a key. In other embodiments, any of the lock receiving apertures which make up the lock receptacle could include the internal flats to engage the barrel lock.

Figure 14:
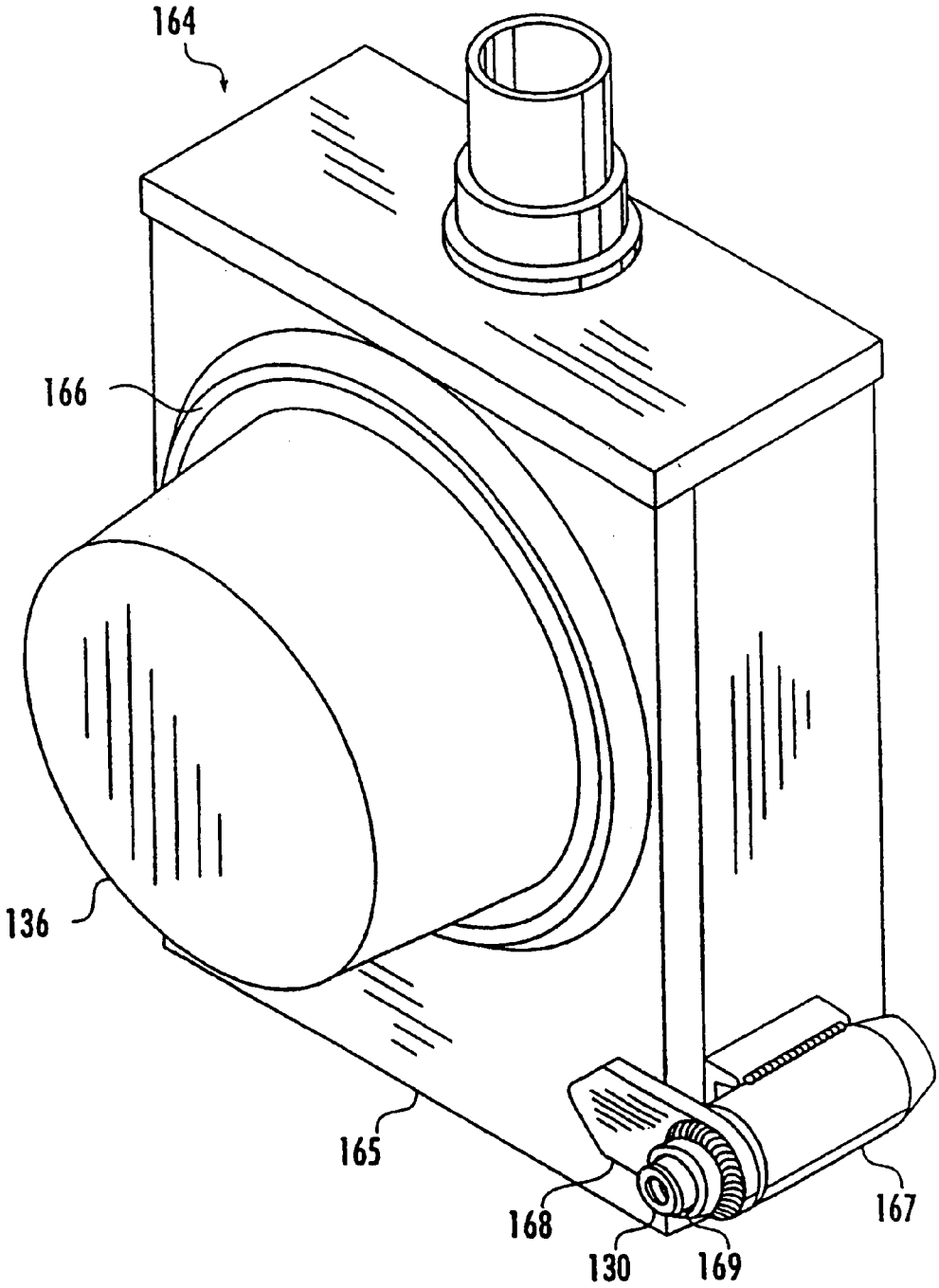
FIG. 14 shows an isometric view of an alternative embodiment meter box lock and barrel lock installed on a typical electric meter box.

FIGS. 14 through 16 show a method for preventing lock rotation in meter box locks. The door 165 of the meter box 164 shown in FIG. 14 has a boss 166 which retains the meter 136 in the meter box. The meter box lock 167 retains the door in the closed position, in a manner well known in the industry. The meter box lock 167 includes a cover plate or similar member 168 which overlays the door 165 when the meter box lock is locked. The meter box lock also includes a lock receptacle 169 for receiving the barrel lock 130. Referring to FIG. 15, the barrel lock 130 has a shank portion 134 with flats 132*a* and 132*b* thereon. Referring to FIGS. 15 and 16, the lock receptacle 169 in the meter box lock includes internal flatted areas 171*a* and 171*b* which engage the flats on the barrel lock, thus preventing the barrel lock from rotating when engaged by a key.

Figure 17A:
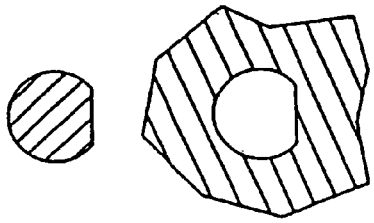
FIGS. 17*a* through 17*h* show various complimentary shapes for the barrel lock shank and lock receptacle to prevent rotation of the lock.
Figure 17B:
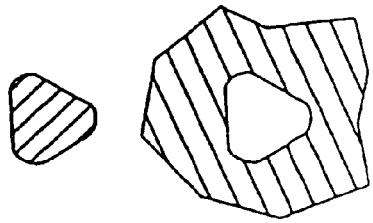
Figure 17C:
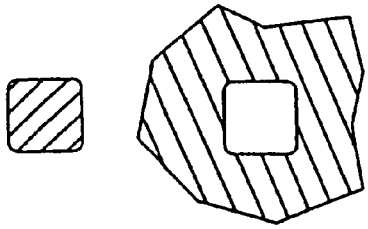
Figure 17D:
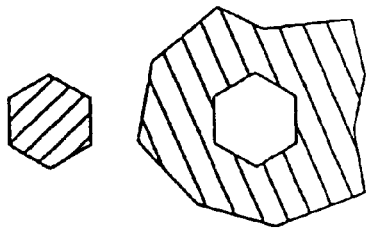
Figure 17E:
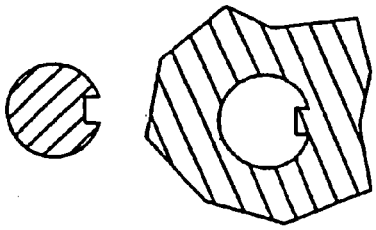
Figure 17F:
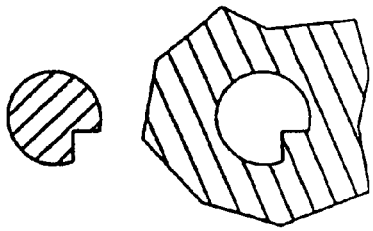
Figure 17G:
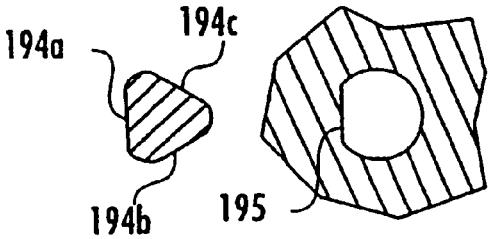
Figure 17H:
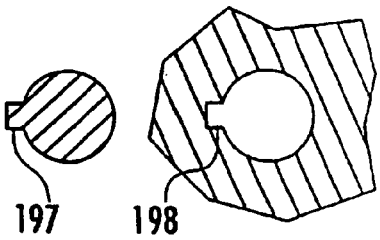

In other embodiments, any other suitable shape could be used in place of the flats on the lock shank and in the lock receptacle to prevent rotation of the lock in the locking hardware. FIGS. 17*a* through 17*d* show barrel lock shanks and lock receptacle using various numbers of flats. It should be understood that any number, size, or position of flats could be used without departing from the scope of the present invention. FIGS. 17*e* and 17*f* show barrel lock shanks with various longitudinal notches, and lock receptacles with complementary splines or prongs therein. FIG. 17*h* shows a lock shank with an external longitudinal spline 197, and a lock receptacle with complementary notch 198. Again, it should be understood that any number, size, shape, or position of notches and splines could be used without departing from the scope of the present invention.

It should also be understood that the barrel lock shank and lock receptacle need not have identical shapes, so long as the shape of the lock receptacle cooperates with the shape of the lock shank to prevent rotation of the barrel lock. FIG. 17*g* shows such an arrangement. The lock shank comprises three flats 194*a*, 194*b* and 194*c*, and the lock receptacle comprises a single flat 195. Although these shapes are certainly not identical, it is obvious that flat 195 could engage any of the flats 194*a* through 194*c* to prevent the barrel lock from rotating, and thereby achieve the objects of the present invention. It is intended that the scope of the present invention cover all combinations of lock shank shape and lock receptacle shape which cooperate to allow insertion of the lock shank into the lock receptacle but prevent rotation of the barrel lock relative to the locking hardware.

I claim:

1. An apparatus for securing a meter to a meter box with a barrel lock, the lock comprising a body, a rotation restricting stop surface of the body, and a variable-radial-play and radially-retracting retaining member having an acute retracting surface, the apparatus comprising:

a hoop; and a lock receptacle connected to said hoop and including a rotation restricting stop surface of said lock receptacle for receiving and preventing rotation of a barrel lock.

2. An apparatus as in claim 1 further comprising the barrel lock.

3. A meter locking ring for use with a rotationally actuated barrel lock, the locking ring having an open and closed configuration and comprising:

a hoop having a split and a generally "U" shaped cross-section having a first and second end at the split;

a housing attached to the first end, said housing comprising a first lock receiving aperture;

a member attached to the second end of said hoop that engages with said housing when the meter locking ring is in the closed configuration and comprising a second lock receiving aperture;

wherein said second lock receiving aperture generally aligns with said first lock receiving aperture in said housing when said meter locking ring is in the closed configuration; and wherein at least one of said first or said second lock receiving apertures comprises a generally circular shape and at least one flat that protrudes into said generally circular shape to restrict rotation within the at least one of said first or said second lock receiving apertures of a rotationally actuated barrel lock.

* * * * *

UNITED STATES PATENT AND TRADEMARK OFFICE

CERTIFICATE OF CORRECTION

PATENT NO. : 7,213,424 B2
APPLICATION NO. : 11/027320
DATED : May 8, 2007
INVENTOR(S) : Binz DeWalch It is certified that error appears in the above-identified patent and that said Letters Patent is hereby corrected as shown below:

On the Title page of the patent, under the heading Attorney, Agent, or Firm, please correct the spelling of "Ferrere" to read --Farrera--.

Column 8, line 65, please correct "a" to read --the-- in the last line of claim 1.

Signed and Sealed this

Twelfth Day of August, 2008

JON W. DUDAS
*Director of the United States Patent and Trademark Office*